United States Patent [19]

Jungbluth

[11] 4,196,558

[45] Apr. 8, 1980

[54] FIRE-RESISTANT CONCRETE AND STEEL STRUCTURAL ELEMENT

[75] Inventor: Otto Jungbluth, Darmstadt, Fed. Rep. of Germany

[73] Assignee: Arbed S.A., Luxembourg, Luxembourg

[21] Appl. No.: 923,697

[22] Filed: Jul. 11, 1978

[30] Foreign Application Priority Data

Jul. 12, 1977 [LU] Luxembourg ..... 77749

[51] Int. Cl.[2] ..... E04C 3/34

[52] U.S. Cl. ..... 52/723; 52/334; 52/340

[58] Field of Search ..... 52/334, 723, 223, 340, 52/515, 647, 733, 226, 694

[56] References Cited

U.S. PATENT DOCUMENTS

| | | | |
|---|---|---|---|
| 139,415 | 5/1873 | Mulford | 52/334 |
| 915,295 | 3/1909 | Himmelwright | 52/647 |
| 930,611 | 8/1909 | Pelton | 52/515 |
| 1,598,693 | 9/1926 | Sereff | 52/340 |
| 1,670,378 | 5/1928 | Powell | 52/515 |
| 1,768,626 | 7/1930 | Pedersen | 52/334 |
| 3,401,497 | 9/1968 | Gregory et al. | 52/733 |

*Primary Examiner*—James L. Ridgill, Jr.
*Attorney, Agent, or Firm*—Karl F. Ross

[57] ABSTRACT

A construction element comprises a wide-flange steel beam having a web-flange thickness ratio of at least 0.8. Anchors or holding members in the form of studs or wire fabric are secured only to the web of the beam, and a reinforcing bar or plate extending along the beam is in turn welded to the achoring members. The area between the flanges of the beam is then filled with a concrete body in which the holding members and reinforcing elements are embedded for fire resistance.

12 Claims, 6 Drawing Figures

FIRE-RESISTANT CONCRETE AND STEEL STRUCTURAL ELEMENT

FIELD OF THE INVENTION

The present invention relates to a construction element. More particularly this invention concerns a fire-resistant reinforced concrete and steel beam.

BACKGROUND OF THE INVENTION

Concrete, which can withstand enormous compressive forces, is frequently combined with steel, which can withstand enormous tensile forces to produce a combined construction element that has the best properties of both materials. Thus it is known to fill a tube or the like with concrete to greatly increase its strength, or to embed reinforcing bars or members in a beam of concrete so as to increase the strength of the concrete beam.

It is also known to increase the fire resistance of a steel or other metallic structural member by covering it with concrete. The concrete acts as a fire-resistant insulator and therefore retards heat transmission to the steel beam embedded in the concrete so that the considerable loss in strength encountered in a fire is at least postponed. This fireproofing is typically carried out by simply spraying the steel structural member after installation with concrete, a procedure which also increases the beam's resistance to corrosion due to the basicity of the concrete coating.

Such arrangements have considerable problems though. First of all the concrete used for fireproofing typically acts merely as dead weight on the beam it is applied to. This concrete has in effect no load-bearing action. Furthermore, if the concrete fireproofing is applied prior to installation a good chance of chipping at least some of it off during handling is encountered. The bonding of the concrete to the steel member can also be problematic, in particular when the thus coated beam is subject to considerable thermal expansion and contraction, as is the case prior to integration into a larger structure.

OBJECTS OF THE INVENTION

It is therefore an object of the instant invention to provide an improved structural element.

Another object is to provide a fireproof structural beam that overcomes the above-given disadvantages.

SUMMARY OF THE INVENTION

These objects are attained according to the present invention in a structural element comprising a wide-flange steel beam having a web and a pair of flanges, whose respective lateral dimensions form a web-flange ratio of at least 0.8. Anchors or holding members are fixed to the web between the flanges and at least one reinforcing bar is secured to these members and extends along the beam between its flanges. A body of concrete is provided between the flanges, and the holding members and the reinforcing bar are completely embedded in this body, with the body forming with the reinforcing bar a reinforced-type concrete beam within the construction element, and with the holding members securing the concrete to the wide-flange beam.

According to the instant invention the 1 body does not project at all beyond the outline of the beam, but instead extends at most to a plane defined by the outer edges of the flanges between which it is received. Furthermore, the reinforcing rods or bars have a yield point ($\beta_s$) of at least 42 kN/cm$^2$, and the concrete has a similar yield point ($\beta_s$) of 3.5 kN/cm$^2$. The total cross-sectional area of the reinforcing rod or rods can reach up to 20% of the cross-sectional area of the flanges.

Such a construction element can be prepared completely in advance, as the concrete body lies within the profile of the wideflange beam, so that expensive on-site fireproofing becomes unnecessary. Furthermore, the structural element according to this invention combines the advantages of a standard steel beam with a reinforced-concrete beam, as the concrete not only fireproofs the element to a large extent, but also adds to the loadbearing capacity thereof.

The holding members according to this invention can be constituted by standard headed studs welded to the web of the beam and extending parallel to the flanges thereof. The reinforcing bars may in turn be welded to the studs, or the reinforcing bar may itself be constituted as a corrugated and elongated steel plate welded to such studs. It is also within the scope of the invention to use a C-section piece of wire fabric having longitudinally extending edges welded to the web of the beam, with the wire fabric therefore open toward the web.

The load-bearing capacity of the structural element according to this invention is in part determined by the load-bearing capacity of the wide-flange beam, and in part by the reinforced-concrete beam contiguous therewith. Normally, such a combined structural element is rated at room temperature. In a fire the beam according to this invention retains its load-bearing capacity, mainly by a transfer of the load from the wide-flange beam to the reinforced-concrete beam. Typically a structural element is employed having a load-bearing capacity that is double the maximum load the beam is expected to encounter in the finished structure. The beam according to the present invention has been shown to lose only half of its load-bearing capacity even after remaining 90 minutes in a fire. This represents a considerable increase in load-bearing capacity in a fire over the prior-art structures.

SPECIFIC DESCRIPTION

Figure 1:
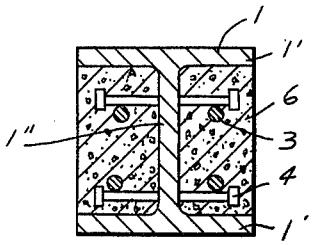
FIGS. 1–4 are cross-sections through structural elements according to this invention.

As shown in FIG. 1 an I-beam 1 having upper and lower flanges 1' and a web 1'' is provided on this web 1'' with a multiplicity of transversely projecting studs 4. Welded to these studs 4 are horizontally extending reinforcing rods 3. The beam 1 has a web/flange ratio of 1:1 and the studs 4 are welded in place to the flange only. Between each of the flanges 1' and the facing flange 1' there is provided a body of concrete in in which the studs 4 and bars 3 are completely embedded. THe bars 3 are extended to at most within 40 mm of the surface of the body 6.

Figure 5:
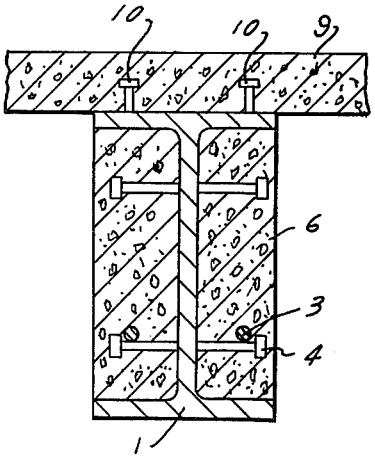
FIGS. 5 and 6 are vertical sections through structural elements according to this invention integrated into further structure.

FIG. 5 shows another arrangement wherein the studs 4 are replaced by a C-section piece of wire fabric 5 to which the bars 3 are welded. The inner edges 5' of the fabric 5 are welded to the web 1''.

Figure 3:
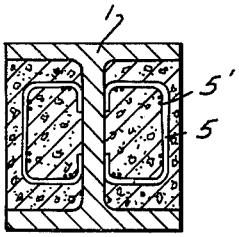

In FIG. 3 the rods 3 are replaced by the standard longitudinally extending wires 5' of the wire fabric 5.

Figure 4:
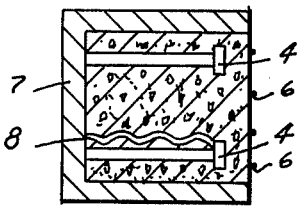

FIG. 4 shows a C-section beam 7 from whose web extend studs 4 to the lower ones of which are welded a reinforcing member 8 in the form of a longitudinally corrugated steel plate. The body 6 of concrete received between the flanges of the beam 7 has a surface that is coated with gravel or stone chips as shown at 6'.

Figure 2:
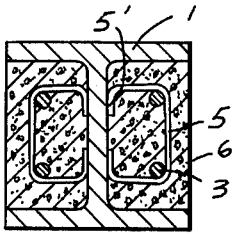
Figure 6:
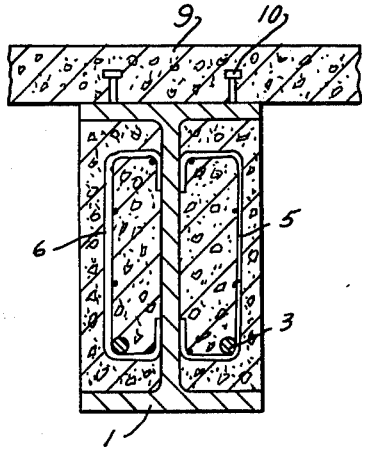

FIGS. 5 and 6 show how beams such as shown in FIGS. 1 and 2, respectively, can be used to support a floor 9, with studs 10 similar to the studs 4 provided on the upper flanges of the beam 1. This beam 1 also has a larger ratio than the beam shown in FIG. 1, and reinforcing bars 3 are only provided in the lower region, so that they only are stressed in tension. It is noted that in this arrangement the tensile strength of the bars 3 can be a multiple of that of the beam 1. In any case the compressive strength of the concrete body 6, especially when confined between the flanges of the beams 1 or 7, greatly adds to the strength of the assembly while insuring excellent fire resistance.

I claim:

1. A construction element comprising:

a wide-flange steel I-beam having a massive one-piece load-supporting web and a pair of flanges projecting laterally and having respective lateral dimensions forming a web-flange thickness ratio of at least 0.8;

holding members fixedly secured to said web between said flanges;

at least one reinforcing bar secured to said members and extending along said beam between said flanges; and two bodies of concrete between said flanges and flanking said web, said members and bar being embedded in said bodies, said flange having fully exposed attachment surfaces out of contact with said bodies.

2. The element defined in claim 1 wherein said concrete has a yield point of at least 3.5 $kN/cm^2$.

3. The element defined in claim 1 wherein said holding members are studs welded to said web and to said reinforcing bar.

4. The element defined in claim 1 wherein said body lies wholly within the outline of said beam.

5. The element defined in claim 1 wherein said reinforcing bar is a corrugated steel plate.

6. The element defined in claim 1, wherein said ratio is about 1:1.

7. The element defined in claim 1 wherein said body has an exposed surface not in contact with said beam that is provided with a coating of gravel.

8. The element defined in claim 1 wherein said bar is embedded at least 40 mm in said body.

9. The element defined in claim 1 wherein said reinforcing bar has a yield point of at least 42 $kN/cm^2$.

10. The element defined in claim 9 wherein the total cross-sectional area of said reinforcing bar is equal to at most 20% of the total cross-sectional area of said beam.

11. The element defined in claim 1 wherein said holding members are constituted by a C-section piece of wire fabric having longitudinal edges welded to said web.

12. The element defined in claim 11 wherein said reinforcing bar is part of said wire fabric.

* * * * *